United States Patent [19]

Knirsch et al.

[11] Patent Number: 4,465,389

[45] Date of Patent: Aug. 14, 1984

[54] THERMOSENSITIVE INKED ELEMENT FOR NON-IMPACT PRINTERS

[75] Inventors: Franco Knirsch, Banchette; Giovanni Gianolini, Lozza, both of Italy

[73] Assignee: Ing. C. Olivetti & C., S.p.A., Turin, Italy

[21] Appl. No.: 417,571

[22] Filed: Sep. 13, 1982

[30] Foreign Application Priority Data

Sep. 21, 1981 [IT] Italy ..... 68228 A/81

[51] Int. Cl.[3] ..... B41J 31/00; B41M 5/26

[52] U.S. Cl. ..... 400/241.1; 400/120; 428/914

[58] Field of Search ..... 400/120, 241, 241.1, 400/241.2, 241.3, 241.4; 428/913, 914

[56] References Cited

U.S. PATENT DOCUMENTS

| | | | |
|---|---|---|---|
| 3,519,456 | 7/1970 | Reed et al. | 400/241.1 X |
| 3,719,261 | 3/1973 | Heinzer et al. | 400/120 |
| 3,825,470 | 7/1974 | Elbert et al. | 400/241.1 X |
| 3,989,131 | 11/1976 | Knirsch et al. | 400/120 X |
| 4,251,276 | 2/1981 | Ferree, Jr. et al. | 400/120 X |
| 4,260,664 | 4/1981 | Dapp et al. | 400/241.2 X |
| 4,315,643 | 2/1982 | Tokunaga et al. | 400/120 X |
| 4,320,170 | 3/1982 | Findlay | 400/120 X |

FOREIGN PATENT DOCUMENTS

| | | | |
|---|---|---|---|
| 2010515 | 6/1979 | United Kingdom | 400/120 |

*Primary Examiner*—Ernest T. Wright, Jr.

*Attorney, Agent, or Firm*—Banner, Birch, McKie & Beckett

[57] ABSTRACT

The inked element in the form of a ribbon comprises a plastics support coated on one side with a thin layer (2 to 4 mm) of thermotransferable inking mixture which comprises, in addition to a pigment or dye, a binder of thermoplastic resin, in particular a styrene or terpene resin, a plasticizer and a softening compound constituted by one or more waxes in a percentage between 18 and 50%. The plasticizer is constituted by an ester of phthalic or phosphoric acid or another polymer.

4 Claims, No Drawings

THERMOSENSITIVE INKED ELEMENT FOR NON-IMPACT PRINTERS

BACKGROUND OF THE INVENTION

The present invention relates to a thermosensitive inked element for non-impact printers of thermal type, comprising a base support of plastics material coated on one side with a thin layer of a mixture transferable, when it is subjected to heat and pressure, to a document being printed. More particularly, the black or coloured inked element, normally a ribbon, is adapted to be disposed between a thermal head and a sheet of ordinary paper and to transfer the heated portions of the inking layer to this paper.

Normally, the inking layer comprises a mixture of solid ink and a binder with a relatively low melting point, whereby this layer can be melted or softened and transferred by means of simultaneous application of heat and pressure. The quality of the printing obviously depends on the speed of the printer, that is on the duration of the energization of a point of the printing head on a corresponding portion of the ribbon.

The quality of the printing moreover depends on the composition of the inking layer, which must soften or melt in the least time possible for taking variations in printing speed and must adhere cleanly to the paper.

An inked ribbon for a thermal printer has been proposed wherein the inking layer comprises as binder a thermoplastic resin adapted to melt at a temperature between 80° C. and 100° C. Since this resin is relatively rigid and brittle at room temperature, in order to reduce the tendency to crack it is spread in a layer with a thickness of the order of tens of microns. This ribbon is not suitable for high-speed printers, both because of the thickness of the ink and because of the high melting temperature.

A thermal ribbon has also been proposed wherein the mixture of the inking layer comprises, in addition to the binding resin, a hydrocarbon wax or plasticizing resin which lowers the melting point of the layer and allows a layer thickness of the order of 2 to 4μ. This layer adheres tenaciously to the paper without being absorbed by it and is not subject to blurring when it is rubbed. However, this ribbon requires a relatively high pressure and adheres with difficulty in the case of high-speed printers.

A thermal ribbon has also been proposed wherein the mixture of the inking layer is very thin and comprises a mixture of natural wax having a relatively high melting point with an esterified wax having a relatively low melting point, in the ratio of 2 parts of esterified wax to 1 part of natural wax. To this there is added a predetermined amount of oil for making the ink penetrate into the paper. Although this layer shows a good readiness to melt, it nevertheless has the disadvantage of permeating the fibres of ordinary paper, as a result of which it tends to form more or less pronounced runs according to the characteristics of the paper. Moreover, it is liable to spread and blur when the printed symbol is rubbed, for example with a finger.

SUMMARY OF THE INVENTION

The object of this invention is to provide an inked element which provides a good quality of printing at the different printing speeds and a good penetration into the paper without forming runs or blurring when it is rubbed, even immediately after printing.

The starting point of the invention is thus a thermosensitive inked element for non-impact printers of thermal type, comprising a base support of plastics material coated on one side with a thin layer 2 to 4μ thick of a mixture transferable to paper when it is subjected to heat and pressure, the mixture comprising a pigment or dye, a binder having a relatively high melting point and a plasticizer having a low melting point. The invention is characterised in that the binder is constituted by a thermoplastic resin and a softener constituted by one or more waxes and corresponding derivatives having a low melting point which is adapted to lower the melting point of the mixture and to improve its penetration into the printing paper.

DESCRIPTION OF THE PREFERRED EMBODIMENTS

The inked element may be in the form of a sheet, for example as in the case of ordinary carbon papers, or in the form of a use-once ribbon. The base support may be constituted by a sheet between 7 and 20μ thick of polyethylene glycol terephthalate, known by the name Mylar (Trade Mark of DuPont) or by the name Hostaphan (Trade Mark of Hoechst). Alternatively, the base support may be constituted by a sheet of polyethylene with a thickness between 7 and 12μ.

The support is covered on one face with a layer between 2 and 4μ thick of a mixture which comprises essentially three constituents: a pigment, for example Raven Carbon Black 1200 (Trade Mark of the Columbia Carbon Co.) and/or a dye, a resin-based binder with a relatively high melting or softening point, and a plasticizer for rendering the mixture more easily spreadable on the support and for making it adhere more easily to the paper.

The binder plays a very important role in the thermal reaction of the layer and in its transfer to the paper.

To this end, the resins may be chosen from among one or more of the following classes: styrene resins (such as the resin known by the Trade Mark Piccolastic of the Pennsylvania Industrial Company), hydrocarbon or terpene resins, such as the resin known by the name Piccolite (Trade Mark of the aforesaid Pennsylvania Industrial Co.). One or more of the following classes of resins may moreover be used: epoxy, ketonic, alkyd, phenolic, maleic, vinyl, hydrocarbon and polyamide resins. These generally have a softening point around 100° C.

According to the invention, the binder is constituted by a balanced mixture of the aforesaid thermoplastic resins and a softeneing substance constituted by one or more waxes which are stable in time. A function of these waxes is to lower the softening or melting temperature of the mixture.

The waxes may be chosen from among one or more of the following classes of compounds: natural waxes, such as carnauba wax, candelilla wax of Cambiaghi S.p.A., mountain wax, beeswax and Japan wax, having a melting point between 75° C. and 85° C.; the microcrystalline/paraffinic waxes, such as the Paraffinic Wax of the Pergamon Wax Co., the S45 Wax of Tillinans S.p.A. and the Micri 60/63 Wax of Spica S.P.A having a melting point between 62° C. and 65° C.; the synthetic waxes such as the esters of fatty acids with glycerine, glycols and higher alcohols, or the amides of fatty acids, with a melting point between 45° C. and 50° C. Among the synthetic waxes, there may be used in particular: the ethylene glycol monostearate of Italcolloid S.p.A, sorbic acid or glycerol monostearate, glycerol tristearate or tripalmitate, stearyl stearate or behenate, behenic, palmitic or stearic acid, or stearyl or oleic amide of Italcolloid S.p.A.

Obviously, the above-mentioned natural, paraffinic and synthetic waxes may be mixed with one another, selecting the compounds most suitable for obtaining the required optimum performance. They may also have a plasticizing function which depends on the proportion in which they are mixed with the resins.

However, according to some preferred formulations, there is added to the mixture a specific plasticizer having the specific function of improving the fluidity of the melted layer, facilitating detachment of the binder from the support and its penetration into the fibres of the paper. As plasticiser there may be used phthalic or phosphoric acid esters with higher alcohols or a polymeric compound. More particularly, dioctyl phthalate (D.O.P) didodecyl phthalate, tributyl phosphate (T.B.P.) and triisobutyl phosphate have been tested with advantage.

Finally, there may be added to the mixture a certain amount of a surface-active substance which serves to lower the surface tension of the mixture, promoting the spreading thereof on the support. As surface-active substance there may be used, for example, a product with a base of naphthenates, such as Aerosol OT 100 of the American Cyanamide Corp., or one of the products known as Raybo 38 and Raybo 6 (Trade Mark of Eigenman Veronelli S.p.A). Tests have been made to obtain an optimum result with a minimum percentage of surface-active substance between 0.1 and 0.5%, for which reason this percentage will be indicated hereinafter by "trace" or "tr".

By choosing the constituents and the relative proportions carefully, ribbons can be obtained with a layer of inking mixture which melts at a temperature around 60° C. and allows good penetration of the ink into the paper and a high definition of the dot without exhibiting the disadvantage of blurring if rubbed. These results prove to be excellent at normal printing speeds, for example of 40 char/sec, and are still very good at double printing speed, thus comprehending the advantages of the known ribbons.

The ribbons obtained require an excitation or energization time of the order of $10^{-3}$ sec and a pressure between 250 and 300 g/cm$^2$, that is to say equal to the pressure required for ensuring contact of the thermal head directly with the usual thermally sensitive printing paper.

By choosing the pigment suitably, ribbons of different colours or even two-coloured ribbons can be obtained.

The Examples given hereinafter illustrate (without limitation) some processes by which good inking mixtures have been obtained.

EXAMPLE 1

170 g of Piccolyte D75 (a hydrocarbon or terpene resin of the Pennsylvania Industrial Company); 30 g of natural wax (carnauba, Candelite or other wax), 15 g of glycerol monostearate, 10 g of dioctyl phthalate (D.O.P), 25 g of Raven Carbon Black 1200 of the Columbia Carbon Co., 500 ml of toluene, 300 ml of methyl isobutyl ketone, 100 ml of methyle ethyl ketone and traces of Aerosol T 100 as surface-active substance were placed in a steel bowl with a capacity of 1750 ml. The mixture was ground for 48 hours and then filtered, a homogeneous dispersion being obtained. This was spread on a Hostaphan ribbon with a thickness of 8$\mu$ and dried. After drying, the inking layer had a thickness of about 4$\mu$ and a melting point of about 60° C. On printing with this ribbon, for example with a thermal head of the type described in the U.S. Pat. No. 3,989,131, assigned to the same assignee as the present application, well-defined black dots were obtained, even at a speed of 80 char/sec, with a pressure of 300 g/cm$^2$. The printed dots showed an optimum adherence together with a certain absorption of the ink in the paper without giving any sign of blurring through rubbing.

EXAMPLE 2

30 g of Piccolyte D70, 40 g of natural wax (carnauba or other wax), 10 g of glycerol tristearate of Italcolloid S.p.A., 15 g of Raven Carbon Black 1200, 5 g of T.B.P. of Plast S.p.A., traces of Aerosol T 100, 100 g of toluene, 100 g of Methyl isobutyl ketone, 50 g of methyl ethyl ketone were placed in a 500 ml bowl. The mixture was then ground for 48 hours, a homogeneous dispersion being obtained. After grinding, the dispersion was spread on Hostaphan with a thickness of 8$\mu$, the inking layer being then caused to dry. After drying, this layer showed a thickness of about 3$\mu$ and a melting point around 60° C. On printing with this ribbon with the aforementioned head, well-defined black dots were obtained, even at printing speeds up to 120 char/sec and with a pressure of the head reduced to 250 g/cm$^2$. The printed dots showed an optimum absorption of the ink by the paper, without runs and substantially without blurring due to rubbing.

Other thermal ribbons were prepared in similar manner by varying the constituents and the relative percentages. More particularly, the percentages of resins and waxes were varied between the limits of the two Examples seen hereinbefore.

The results of the ribbons obtained were always satisfactory, with an absence of blurring due to rubbing and a certain increase in the absorption of the ink in the paper and an increase in the definition of the dot even at high speeds with an increase in the percentage of waxes.

The following table gives the percentages of the constituents in the various mixtures tested, included those of the two foregoing Examples.

| | Example | | | | |
|---|---|---|---|---|---|
| Constituent | 1 | 2 | 3 | 4 | 5 |
| Terpene or hydrocarbon resin | 68 | 30 | 45 | 40 | 30 |
| Carnauba or other natural wax | 12 | 40 | 25 | 30 | 30 |
| Esterified Wax | 6 | 10 | 10 | 10 | 10 |
| Paraffinic Wax | | | | | 10 |
| Plasticizer (D.O.P.) or (T.B.P.) | 4 | 5 | 5 | 5 | 5 |
| Raven Carbon Black 1200 | 10 | 15 | 15 | 15 | 15 |
| Surface-active Substance | tr. | tr. | tr. | tr. | tr. |

It is understood that other variations may be made in the ribbon described, by substituting other constituents for the binders, the plasticizer, the surface-active substances and the pigment or dye or by varying the percentages thereof, without departing from the scope of the invention.

We claim:

1. A thermosensitive inked element for a non-impact printer of the thermal type, comprising a base support of plastics material having a thickness comprised between 7 and 20μ, said base support being coated on one side with a layer 2 to 4μ thick of a mixture transferable from said base support to a printing paper when said inked element is subject to heat and is pressed against said paper, said mixture comprising a pigment or dye, a binder including one or more hydrocarbon resins with a softening point around 100° C., and a plasticizer, characterized in that said binder includes a softener constituted by one or more natural or synthetic waxes and esters of said waxes having a low melting point and in a proportion ranging between 20 and 50% of the mixture so as to lower the melting point of the mixture and to improve its penetration in said paper, said plasticizer being in a proportion not exceeding 5% of said mixture.

2. An inked element according to claim 1 characterised in that the resin is a terpene resin, the softener comprising a natural wax in a proportion ranging between 12 and 40% of the mixture and an esterified wax in a proportion ranging from 6 to 10% of the mixture.

3. An inked element according to claim 2, characterised in that the softener moreover comprises a paraffinic wax in a proportion not exceeding 10%.

4. An inked element according to claim 1 characterised in that the plasticizer is one of the following compounds: esters of phthalic or phosphoric acid with higher alcohols, dioctyl phthalate, didodecyl phthalate, tributyl phosphate, triisobutyl phosphate or another polymer, in a percentage ranging between 4 and 5%, so as to improve the fluidity of the melted layer and to facilitate the detachment of said binder from said base support.

* * * * *